United States Patent [19]

Mansur

[11] Patent Number: 4,687,096

[45] Date of Patent: Aug. 18, 1987

[54] CONTAINER FOR GOLF ACCESSORIES

[76] Inventor: Paul G. Mansur, 3232 Hilary Cir., Palm Harbor, Fla. 33563

[21] Appl. No.: 887,351

[22] Filed: Jul. 21, 1986

[51] Int. Cl.[4] ..... B65D 85/00

[52] U.S. Cl. ..... 206/315.9; 206/558; 206/564; 220/22; 220/306

[58] Field of Search ..... 206/315.9, 315.2, 315.5, 206/315.6, 564, 562, 561, 558, 568, 471; 220/22, 306, 353, 356; D9/341; 224/918

[56] References Cited

U.S. PATENT DOCUMENTS

| | | | |
|---|---|---|---|
| D. 225,785 | 1/1973 | Geddis | D9/341 X |
| 1,876,181 | 9/1932 | Tussing | 206/561 X |
| 3,850,333 | 11/1974 | Reichert | 206/356 X |
| 3,945,490 | 3/1976 | Thompson | 220/306 X |
| 4,082,209 | 4/1978 | Saunders | 224/918 X |

*Primary Examiner*—William Price
*Assistant Examiner*—Michael J. Shea
*Attorney, Agent, or Firm*—Ronald E. Smith

[57] ABSTRACT

A container for holding accessories of the type used in playing the game of golf. The container has a base member that is subdivided into a plurality of small compartments for retaining golf balls and a larger compartment or tray member that may hold car keys or other items. A flange is formed around the perimeter of the tray member, and apertures larger in diameter than the diameter of a tee body but smaller in diameter than a tee head are formed in the flange so that tees may be mounted in the apertures in a suspended position. The container further includes a closure member that caps the base member and that conforms in shape to the base member. A snap fit locking arrangement is provided between the base member and the closure member.

5 Claims, 8 Drawing Figures

CONTAINER FOR GOLF ACCESSORIES

BACKGROUND OF THE INVENTION

1. Field of the Invention

This invention relates, generally, to containers of the type specifically designed to hold golf balls, tees and other miscellaneous items. More particularly, this invention relates to a container having interlocking parts that fit together in a unique configuration.

2. Description of the Prior Art

Many trays and containers have been developed over the years that have utility in connection with the game of golf. Typically, the trays and containers have means for holding golf balls, tees, and other items that a golfer might want to remove from a pocket or purse while on the course.

U.S. Pat. No. 1,845,088 to Hunerhoff shows a golf bag having a compartment for holding golf balls and a subcompartment for holding tees. Both the compartment and the subcompartment are closed by a zipper. Since golf bags are subject to the deleterious effects of weather, the zipper may get rusty and become disfunctional.

An 1884 Patent to Shepard, U.S. Pat. No. 298, 125, shows a container specifically designed to accommodate lawn tennis implements such as tennis balls and shoes. It would therefore have some utility as a golf accessories holder. However, the container has no closure member and no means are provided for holding tees.

U.S. Pat. No. 3,753,519 to Gammon shows a golf accessory carrier that holds ball markers, tees, coins, and the like. The carrier is provided with a clip so that it can be secured to a golf bag, a shirt pocket, or other suitable support surface. The device includes no means for holding golf balls.

A golfer's pocket kit is shown in U.S. Pat. No. 3,799,331 to White. The kit includes a plurality of tee-receiving apertures, and means for holding ball markers, a pencil, and a box of matches. No provision is made for holding golf balls.

A carrying case having the general appearance of a brief case is shown in U.S. Pat. No. 3,848,737 to Kenon. It includes means for carrying golf clubs, balls, tees, and other items.

Other U.S. patents of interest include U.S. Pat. Nos. 4,151,937 to Jarosh and others; 1,754,495 to Anderson; 2,536,725 to Cleveland; 2,846,077 to Kozub; 3,062,422 to Lord; and 3,497,676 to Gravatt.

SUMMARY OF THE INVENTION

The present invention adds to the art of golf accessory holders by providing a container for sundry items having an interlocking base and closure means. The base means is compartmented to hold balls, tees, and other items; the act of capping the base with the closure means interlocks the closure means and the base means so that the contents of the container are held securely.

The device is made of flexible materials so that the interlocking mechanism can be readily disengaged by a momentary depression of the side walls of the base means.

A central tray means, in a first embodiment of the invention, is surrounded by a flange means having tee-receiving apertures formed therein; the tray is flanked by ball-retaining compartments that are positioned in a plane downwardly of the tray.

The closure member conforms in shape to the base member, but is of slightly larger dimension so that it surrounds and overlies the base member when disposed in capping relation thereto.

Ridges formed on opposed end walls of the closure member abuttingly engage the upper edges of the base member when the base member is capped by the closure member; the abutting engagement positions the two members in registry.

An important object of this invention is to advance the art of containers having utility to golfers.

A more specific object is to provide a container having only two parts.

Another object it to provide a container having interlocking parts so that it remains closed when unattended.

Still another object is to provide a container of unique design that advances the art of containers in general.

The invention accordingly comprises the features of construction, arrangement of parts and combination of elements as exemplified in the construction hereinafter set forth, and the scope of the invention is set forth in the claims appended hereto.

BRIEF DESCRIPTION OF THE DRAWINGS

For a fuller understanding of the invention, reference should be made to the following detailed description, taken in connection with the drawings in which.

Similar reference numerals refer to similar parts throughout the several views of the drawings.

DETAILED DESCRIPTION OF THE PREFERRED EMBODIMENT

Figure 1:
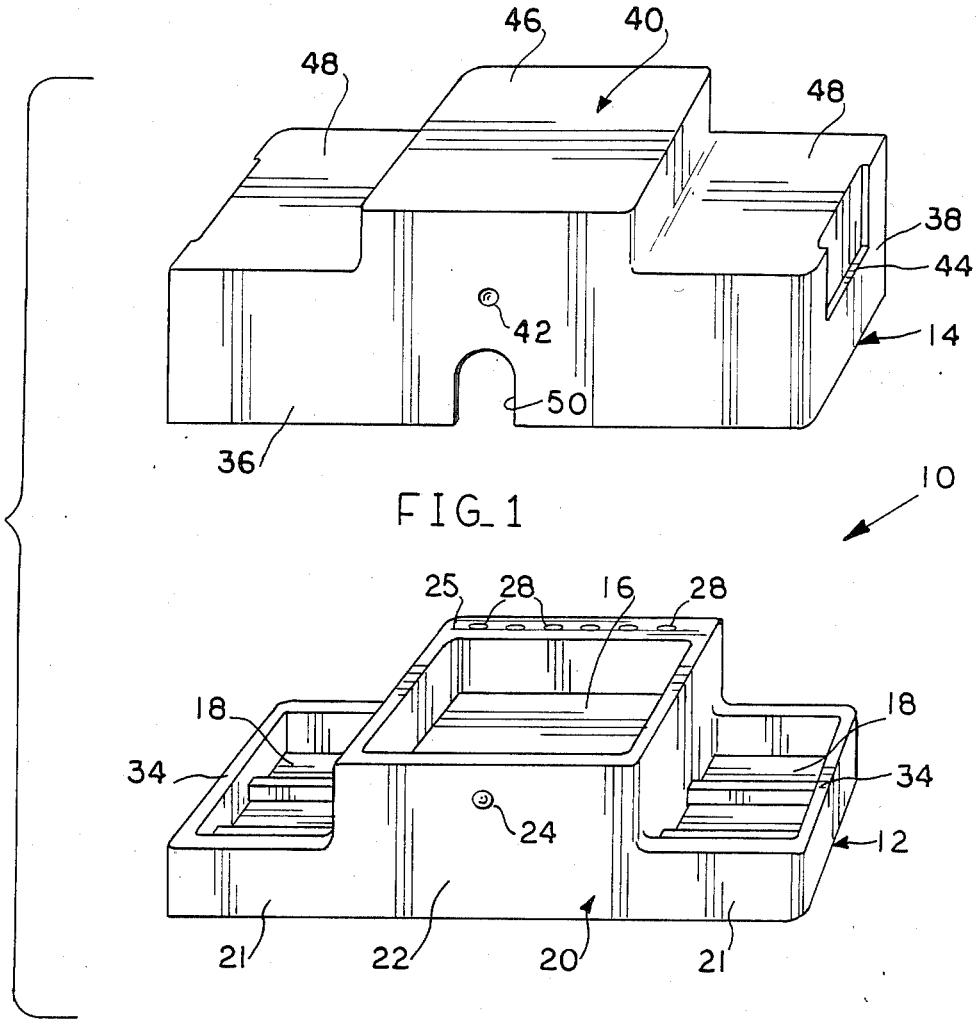
FIG. 1 is an exploded perspective view of the base member and closure member of this invention.
Figure 2:
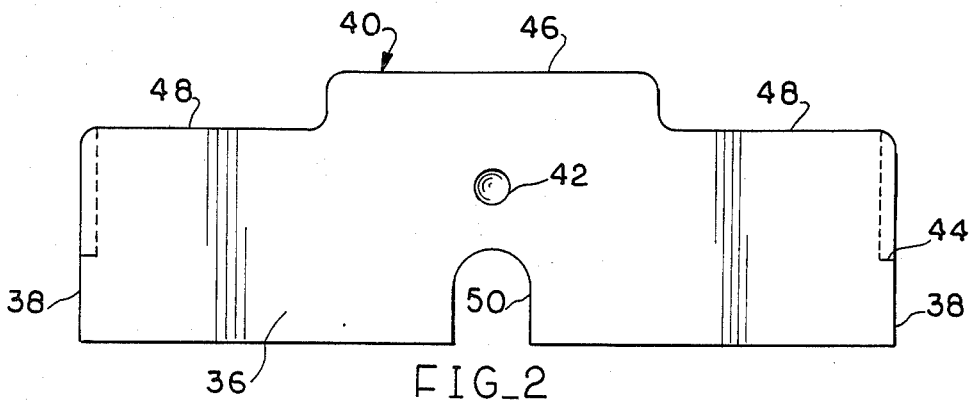
FIG. 2 is a side elevational view of the closure member.

Referring now to FIG. 1, it will there be seen that a structure embodying the teachings of this disclosure is designated by the reference numeral 10 as a whole.

Base member 12 is capped by closure member 14 when the device is assembled. Accordingly, closure member 14 conforms in shape to base member 12 but has a slightly larger size so that it can overlie base member 12 when the container means of this invention is assembled.

Figure 3:
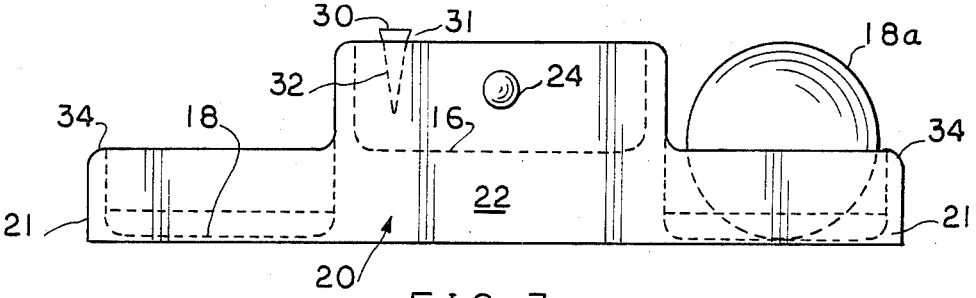
FIG. 3 is a side elevational view of the base member.
Figure 4:
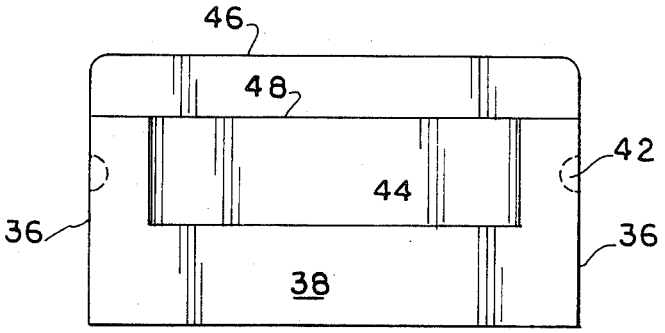
FIG. 4 is an end view of the closure member.
Figure 5:
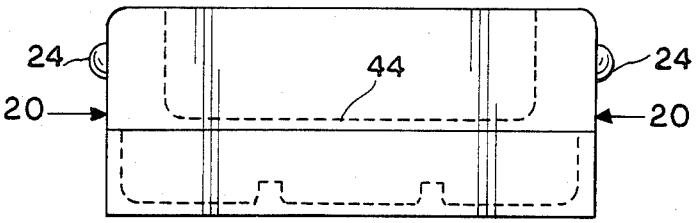
FIG. 5 is an end view of the base member.

Base member 12 has a tray member 16 positioned intermediate of golf ball-retaining compartments, which compartments are collectively designated 18. As seen in FIG. 3, tray member 16 is positioned on a plane higher than compartments 18.

Base 12 has no bottom wall; as depicted in FIGS. 1 and 3, it includes a pair of transversely spaced side walls 20 having opposite end, reduced height portions 21 and medial portion 22 positioned therebetween having a height that extends above the reduced height portions 21. The height of the reduced height portions is sufficient to prevent a golf ball 18*a* (FIG. 3) positioned in a compartment 18 from rolling out of the base member when closure member 14 is separated therefrom.

A bulbous protrusion 24 is formed on each medial portion 22, substantially centrally thereof. Protrusion 24 has a hemispherical configuration.

Figure 6:
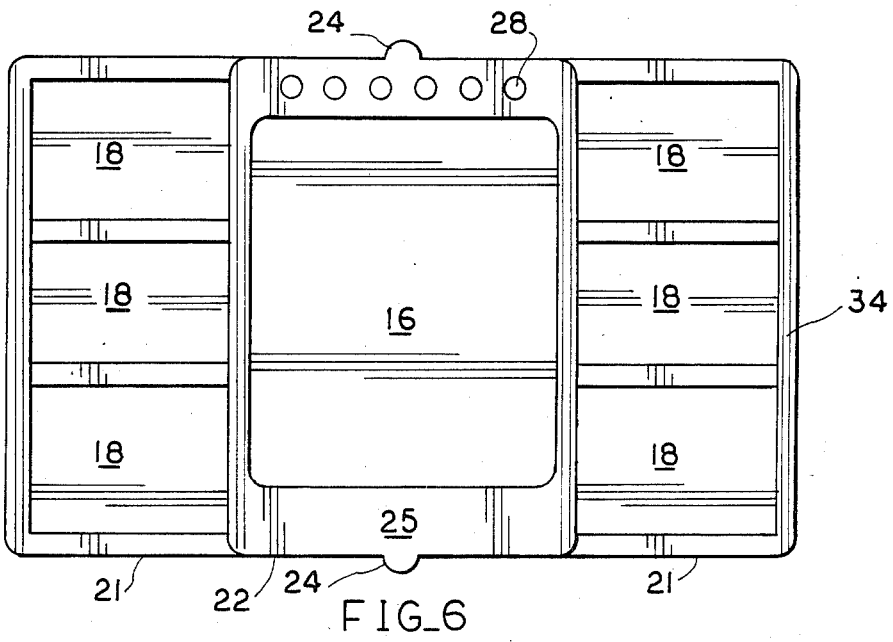
FIG. 6 is a top plan view of the base member.
Figure 7:
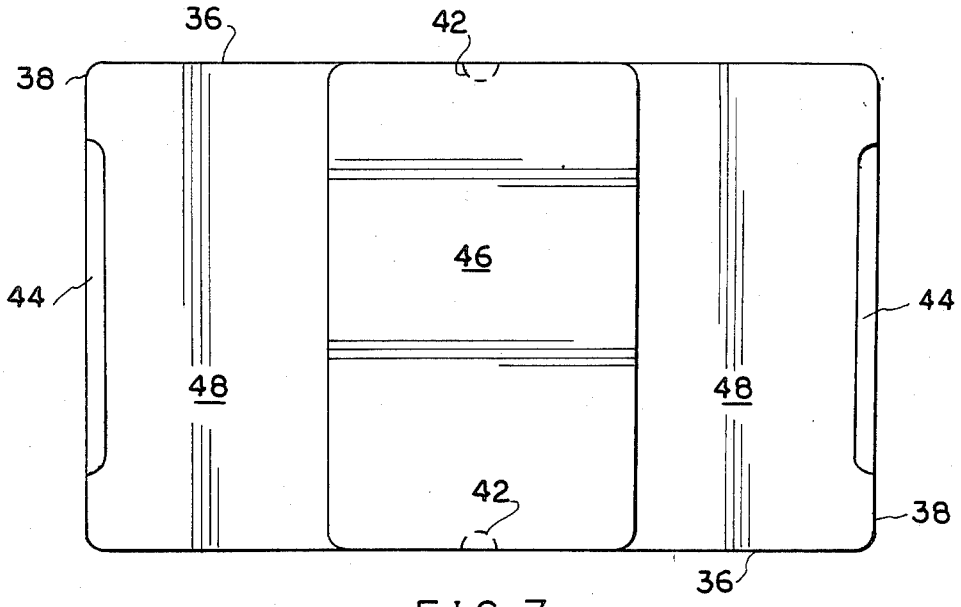
FIG. 7 is a top plan view of the closure member.

As shown in FIGS. 1 and 6, tray member 16 is surrounded by a flange 25 within which is formed a plurality of equidistantly spaced and linearly aligned aperture means collectively designated 28. A golf tee 30 (FIG. 3) may be placed in an aperture 28 in the manner depicted; the large size of tee head 31 prevents the tee from falling through aperture 28. The height of medial portion 22 is greater than the length of the body 32 of a tee 30 so that when base member 12 is positioned atop a support surface, the lowermost portions of the tees will be spaced upwardly of such support surface and will thus not be disengaged from their respective apertures 28 by an upwardly directed force exerted by said support surface.

FIGS. 1 and 6 also show that a ridge 34 extends about the perimeter of compartments 18; this ridge is abuttingly engaged by a mating portion of the closure member 14 when the device is assembled.

Closure member 14, as shown in FIGS. 1, 2, 4 and 7, is formed by a pair of transversely spaced side walls 36, longitudinally spaced end walls 38, and an imperforate top 40. A recess 42 is formed on the interior side of each side wall 36; these recesses snap fittingly engage protrusions 24 formed on base member side walls 20 to interlock members 12 and 14. Recess 42 is hemispherical in shape.

End walls 38 of closure member 14 have an inwardly directed ridge 44 formed therein; these ridges abuttingly engage ridge 34 that extends around the perimeter of compartments 18 when closure member 14 is brought into overlying relation to base member 12. The abutting engagement of ridges 34 and 44 positions base member 12 and closure member 14 into their operative registry and serves to align the protrusions 24 and recesses 42 that provide the snap fit engagement therebetween.

Medial portion 46 of closure member top wall 40 is raised with respect to top wall end portions 48, which end portions 48 overlie ball compartments 18 when the invention is assembled. This provides a clearance for the tees positioned in apertures 28.

A finger or thumb-receiving cut away 50 is formed in side walls 36 of closure member 14; the size of container 10 is such that a human hand of normal size can span its transverse dimension. Thus, when it is desired to disengage closure member 14 from its snap fit enagement with base member 12, a thumb is placed in registration with a cut away portion 50 and a finger of the same hand is placed into registration with another cut away portion 50 on the opposite side of container 10. The hand is then contracted to impart a convergence of base member side walls 20 so that protrusions 24 withdraw from recesses 42. Closure member 14 is then separated from base member 12 with a free hand and the contraction of the hand holding container 10 is relaxed so that side walls 20 of base member 12 may return to their respective original positions. Base member 12 and closure member 14 are both formed of a resilient material, such as a suitable plastic.

Figure 8:
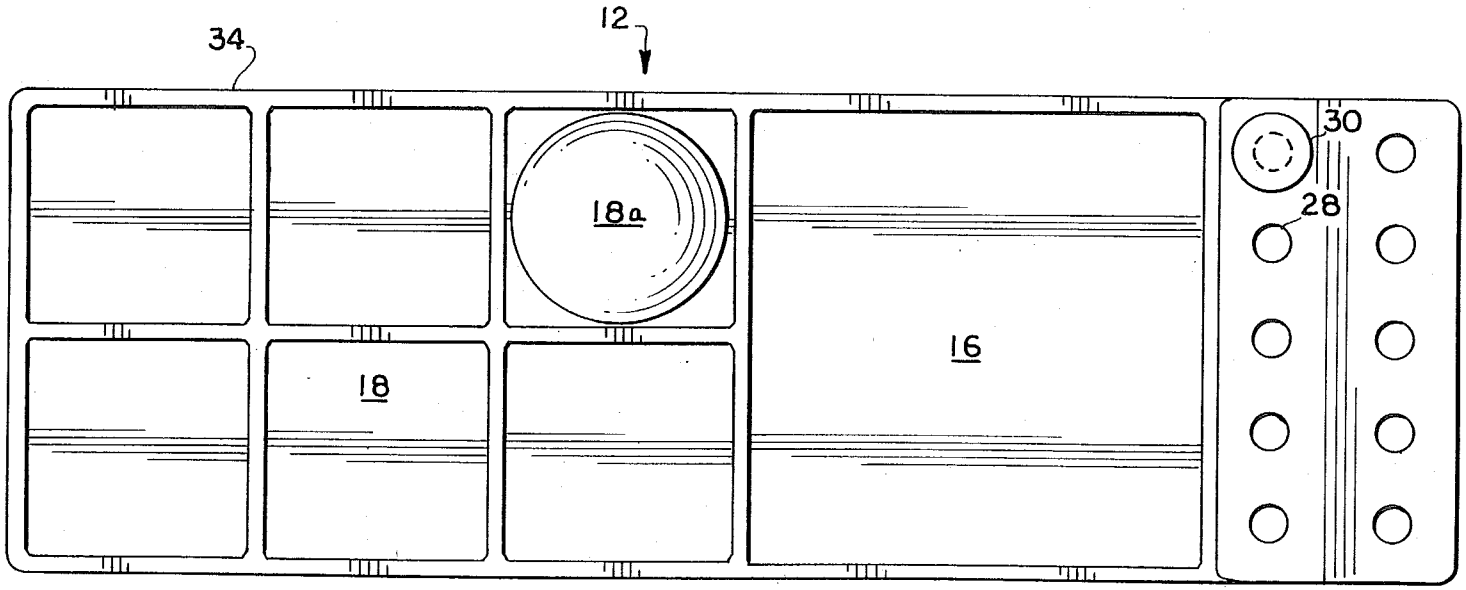
FIG. 8 is a top plan view of the base member of a second embodiment of the invention.

The base member 12 of a second embodiment of the invention is depicted in FIG. 8. In this embodiment, ball-retaining compartments 18 are grouped on a first side of tray 16 as shown and tee-receiving apertures 28 are grouped on a second side thereof.

In either embodiment, the invention is used as follows: the golfer places tray 10 in a desired location such as the trunk, glove compartment, or other storage location of an automobile or other road vehicle. He or she will probably prefer to place cover 14 over base 12 during such times as the tray is so stored. Upon arriving at a golf course, the owner of tray 10 most likely will remove cover 14 and transport base 12 only to a golf cart; in this manner, he or she can keep base member 12 in the cart so that items stored therein will be in the golf cart with the golfer as the game is played. Upon completion of the game and return by the golfer to his or her road vehicle, base 12 is returned to the trunk and cover 14 is placed in closing relation thereto. Some golfers may prefer to take cover 14 to the golf cart as well, however. In either event, a golfer with a fully equipped tray 10, i.e., having balls and tees therein, will always be ready for play if he or she has the vehicle in which the invention is stored available at the course. All that needs to be done upon arrival at a course, whether said arrival was planned in advance or a result of a whim or unexpected invitation, is (1) remove tray 10 from the trunk as aforesaid, (2) transport said tray 10, with or without cover 14, to the golf cart, (3) deposit into tray 10 such items as a watch, a ring, change or other items of which the golfer prefers to be free when golfing, and (4) store tray 10 and the items deposited thereinto at a suitable location on the cart. Play can then take place and the important items stored in tray 10 will remain, in effect, in the immediate control if not in the direct possession of the owner since the cart will always be always near the golfer throughout the course of a typical game. It is a simple matter after play to (1) retrieve the stored personal items from tray 10, (2) restore the balls and tees to their respective positions in tray 10 and (3) return tray 10 to the trunk for future use. Tray 10 thus enables a golfer to be ready to play at all times and just as importantly enables the golfer to keep valuables in the golf cart during play in one compact and versatile storage tray.

Other arrangements of the parts of tray 10 are within the scope of this invention, since the specifically depicted arrangements are merely exemplary of the teachings of this invention.

Those skilled in the material arts will recognize that container 10 is vacuum formed, there being a separate mold for base 12 and cover 14. Thus, the invention is inexpensive to manufacture and is therefore affordable by consumers.

It will thus be seen that the objects set forth above, and those made apparent from the foregoing description, are efficiently attained and since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. A container for golf balls, tees, and other accessory items, said container of the type having utility in connection with the storage of golf accessory items in the trunk, glove compartment or other storge facility provided in an automobile or other road vehicle between games of golf and storage of personal items during actual play, said tray being taken from a trunk or other storage facility at the commencement of play and returned thereto after play, and being kept on a golf cart during play, comprising:

a base means;

a plurality of compartments formed in said base means;

each of said compartments specifically configured and dimensioned to retain therein a golf ball;

a tray means formed in said base means;

said tray means specifically configured and dimensioned to retain therein car keys and other sundry items;

a plurality of tee-retaining means formed in said base means;

each of said tee-retaining means specifically configured and dimensioned to releasably mount a tee therein;

a closure means for capping said base means;

said closure means having a planform substantially conforming to the planform of said base means and having a dimension slightly larger than said base means so that said base means is capped when said closure means is positioned in overlying relation thereto;

interlocking means for releasably engaging said base means and said closure means;

registration means formed in said base means and in said closure means to provide a means whereby said closure means may be properly and operatively positioned with respect to said base means when the base means is capped by said closure means;

said base means and said closure means formed of flexible material;

said interlocking means including a hemispherical in configuration recess portion formed in said closure means and a complementally formed protrusion portion formed on said base means, said recess and protrusion portions entering into snap fit alignment with one another when said base means is capped by said closure means;

said base means including at least one side wall upon which is formed said protrusion portion;

said closure means including at least one side wall within which said recess portion is formed;

a finger or thumb-receiving cut away portion formed in said closure means side wall so that a side wall of said base means may be momentarily depressed to disengage the interlocking snap fit between said closure means and said base means;

said registration means including an inwardly projecting ridge means formed in a side wall of said closure means, said ridge means abuttingly engaging an uppermost edge of a side wall of said base means when said closure means is positioned in overlying relation to said base means, said abutting engagement preventing said closure means from entering into a closer fit with said base means.

2. The container of claim 1, further comprising:

a flange means positioned in surrounding relation to said tray means;

a plurality of aperture means formed in said flange means;

each of said aperture means dimensioned to suspendly receive therein a golf tee.

3. The container of claim 2, wherein said tray means and said flange means are positioned at an elevation upwardly of said golf ball-retaining compartments so that tees suspended in the aperture means formed in said flange means have sufficient clearance to hang freely when said base means is positioned atop a support surface.

4. The container of claim 3, wherein said closure means has a medial portion positioned intermediate a pair of end portions, wherein said medial portion projects upwardly with respect to said end portions, wherein said medial portion is formed in registration with said tray means and wherein said end portions are formed in registration with said golf ball-retaining compartments.

5. A container for golf balls, tees, and other accessory items, said container having utility in carrying said items between a storage location such as a trunk or a glove compartment of a road vehicle and a golf cart, comprising:

a base member of generally rectangular configuration when seen in plan view;

said base member including a tray means and a plurality of compartments formed separately from said tray means;

said tray means positioned centrally of said base member and said plurality of compartments being disposed laterally of said tray means on opposite sides thereof and being divided by said tray means into two groupings of equal numbers of compartments;

said tray member being positioned in a plane disposed upwardly of said compartments so that said base member, when seen in side elevation, has a tray-defining central portion that is raised with respect to said compartments;

a closure member;

said closure member being configured and dimensioned to enclose said base member and to that end having a central portion which is raised with respect to end portions flanking said central portion;

said raised central portion of said closure member having a vertical dimension greater than the vertical dimension of said tray means so that a clearance space having a predetermined height is formed between an uppermost plane of said tray means and a lowermost plane of said closure member central portion;

said tray means having a transverse dimension less than the transverse dimension of said base member;

a pair of flange means being defined by said aforesaid difference in dimension between said transverse dimensions of said tray means and base member;

a plurality of linearly aligned apertures formed in said flange means, each of said apertures being dimensioned to slidingly receive therein a golf tee;

means for effecting a snap fit between said base member and said closure member;

said snap fit means provided in the form of hemispherical in configuration protrusion formed in a side wall of said base member and a complementally formed recess formed in a side wall of said closure member, said hemispherical in configuration snap fit means being positioned in registration with one another when said tray means is closed.

* * * * *